US006637521B2

(12) United States Patent
Saitta

(10) Patent No.: US 6,637,521 B2
(45) Date of Patent: Oct. 28, 2003

(54) EARTH BORER

(75) Inventor: Robert S. Saitta, Broken Arrow, OK (US)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/902,677

(22) Filed: Jul. 11, 2001

(65) Prior Publication Data

US 2003/0010538 A1 Jan. 16, 2003

(51) Int. Cl.[7] ..... E21B 7/26; E21B 17/046; E21B 10/04

(52) U.S. Cl. ..... 175/19; 175/320; 175/404; 408/204; 408/227

(58) Field of Search ..... 175/19, 20, 320, 175/403, 417, 421, 404; 279/93, 104; 408/204, 207, 227, 226, 238

(56) References Cited

U.S. PATENT DOCUMENTS 1,657,368 A * 1/1928 Carter ..... 175/234
4,207,954 A * 6/1980 Jerome ..... 175/404
4,657,445 A * 4/1987 Bossler ..... 175/404
5,098,234 A * 3/1992 Judkins et al. ..... 408/204
6,102,135 A * 8/2000 Shaw ..... 175/20
6,412,575 B1 * 7/2002 Harrigan et al. ..... 175/20

FOREIGN PATENT DOCUMENTS

GB 2149329 A * 6/1985 ..... B23B/27/16

* cited by examiner

*Primary Examiner*—David Bagnell
*Assistant Examiner*—Brian Halford
(74) *Attorney, Agent, or Firm*—Sidley Austin Brown & Wood, LLP

(57) ABSTRACT

An earth borer includes a thin-walled tubular shaft (4), a shank (2) provided at one end of the tubular shaft (4), and a drilling head (5) provided at another, opposite end of the tubular shaft, projecting radially beyond the tubular shaft (4), and having at least one cutter for breaking the bore core and (6, 6*a*, 6*b*, 6*c*, 6*d*) extending, at least partially, radially inward and at least one internal groove (7, 7*a*, 7*b*) associated with the at least one cutter, and a releasable tubular connection member (8) for drivingly connecting the shank (2) with tubular shaft (4) for joint rotation with each other.

4 Claims, 2 Drawing Sheets

EARTH BORER

BACKGROUND OF THE INVENTION

1. Field of the Invention

The present invention relates to an earth borer and, in particular to an earth borer for forming bait traps such as, e.g., traps for termite bait.

2. Description of the Prior Art

For suppressing of vermins, usually a bait is used which the vermins usually eat and perish. The bait trap should be suitably placed in locations were an accumulation of vermins is observed. The bait is usually placed in cylindrical formations.

Blind bores, in which a bait cylinder is placed and which are formed with conventional earth borers, have a reduced useful depth due to the destruction of the bore wall and earth accumulation on the bore bottom. Therefore, in order to accommodate a bait cylinder having a predetermined length, the blind bores have to be made deeper than the length of the bait cylinder. In addition, the removable earth contaminates the area surrounding the blind bore.

U.S. Pat. No. 5,595,746 discloses forming blind bores in affected wooden structures in which termite bait is placed.

Conventional hollow crown drills such as, e.g., disclosed in U.S. Pat. No. 5,980,168, are not suitable for forming blind bores in an earth surface. The disclosed drill is designed for forming bores in concrete, in masonry, and the like. It includes a thin-walled tubular shaft, a shank provided at one end of the shaft, and drilling head provided at another opposite end of the shaft. The drilling head is equipped with a plurality of cutters uniformly distributed over its circumference. With the disclosed crown drill, circular cylindrical recesses are formed, with the cores, which remain after drilling, being subsequently broken. Clearly, such a drill is not suitable for forming bores for bait cylinders.

U.S. Pat. No. 6,082,472 discloses an earth drill with a tubular shaft having smooth inner and outer surfaces, and a drilling head provided at an end of the tubular shaft. The drilling head has a plurality of cutters, which are distributed over its circumference, and helical strips provided on the drilling head circumference for removal of the drilled-off earth. However, the strips damage the inner edge of the formed bore upon withdrawal of the drill.

German Patent DE 42 28 580C1 discloses an earth borer for forming blind bores and having a drilling head with a radially outer helice and provided at an end of a smooth tubular shaft the diameter of which exceeds that of the drilling head. The shaft forces the compressed earth into the inner wall of the bore. However, an increased axial length of the shaft, necessary for compressing the earth, makes this bore unsuitable for forming blind bores for bait cylinders.

Japanese Publication JP2021787 discloses and earth borer having a shaft with smooth inner and outer surfaces, and a drilling head with a plurality of tangent projecting cutters uniformly distributed over the drilling head circumference and with a diametrically arranged flat cutting tip axially retracted with respect to the cutters. The drilling head further includes drillings removal openings located on opposite sides of the cutting tip and in the interior of the tubular shaft. For removal the earth or for cleaning the tubular shafts, there is provided an additional rotatable inner helix. The borer is rather complicated and expensive to produce.

Accordingly, an object of the present invention is to provide an earth borer for forming a blind bore for a bait trap and the depth of which would correspond to the required useful depth to the most possible extent.

SUMMARY OF THE INVENTION

This and other objects of the present invention, which will become apparent hereinafter, are achieved by providing an earth borer including a thin-walled tubular shaft having smooth inner and outer surfaces, a shank provided at one end of the tubular shaft, a drilling head provided at another, opposite end of the tubular, shaft, projecting radially beyond the tubular shaft, and having at least one cutter extending, at least partially, radially inward, and at least one internal groove associated with the at least one cutter, and a releasable tubular connection member for drivingly connecting the shank with the tubular shaft for joint rotation with each other.

The smooth outer edge of the shaft insures support and predetermined positioning during the drilling process, with the radially inward extending cutters breaking the bore core and providing for displacement of the earth into the interior of the tubular shaft. Therefore, the inner edge does not collapse. After the blind bore is formed and the borer is withdrawn, the earth that accumulated in the tubular shaft can be easily removed after the tubular connection member has been disconnected from the shaft. The compacted core, which was formed in the interior of the tubular shaft, easily slides along its smooth inner surface. The shaft can be emptied at a predetermined location, without contaminating of the space surrounding the bore.

Advantageously, the tubular connection member has a radially offset, preferably circular rim coaxial with the tubular shaft, with the tubular shaft and the rim fitting into each other. The circular rim provides for a rotationally symmetrical proportional guidance of the shaft together with the drilling head.

Advantageously, the tubular wall of the tubular shaft has, at its side adjacent to the shank, a plurality of tangent-bent, in a rotational direction of the borer, slots open at their respective end sides. The tubular connection member has a corresponding plurality of radially projecting driving elements engageable in respective slots for drivingly connecting the shank with the tubular shaft. The slots and the driving elements form a bayonet connection. The bayonet connection provides for quick connection and disconnection of the tubular shaft with the shank by rotating the tubular connection member by an angle of less than 90°.

Preferably, the drilling head has a rim for fixedly circumferentially connecting the drilling head with the tubular shaft, advantageously by welding. Such a connection permits to transmit high torques from the shaft to the head.

In a advantageous embodiment of the earth borer according to the present invention, the cutter is arranged mirror-symmetrically with respect to each other. The cutter has a flat bottom surface in a radial direction and tapers towards a tip point lying on a borer axis and diametrically spans the head rim. The above-described borer is particularly suitable for forming bores in a hard ground.

According to an alternative embodiment of a borer according to the present invention, the drilling head has four cutters which are arranged rotationally symmetrically over the drilling head with respect to the borer axis, are sector-shaped, and taper from the head rim toward the borer axis without touching the axis. All of the cutters have a flat bottom surface in their radial direction. Such a borer is suitable for drilling of a loose light soil.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
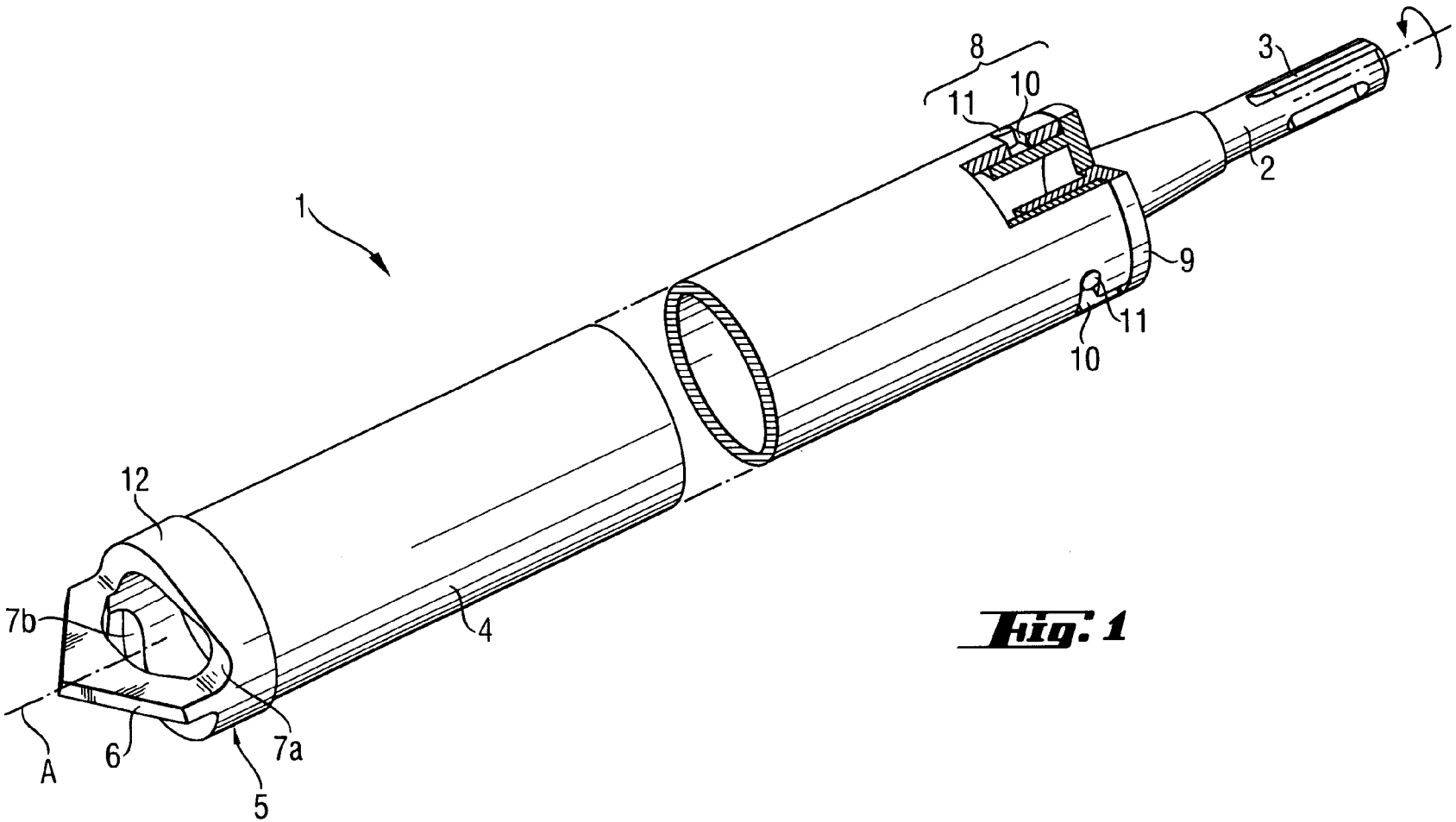
FIG. 1 a perspective, partially cross-sectional view of a first embodiment of an earth borer according to the present invention.

An earth borer 1 according to the present invention, which is shown in FIG. 1, has a shank 2 provided with driving grooves 3, and thin-wall tubular shaft 4 having smooth inner and outer surfaces. At the free end of the shaft 4, there is provided a drilling head 5 which extends radially slightly beyond the shaft 5. The drilling head 5 is equipped with extending radially inward, arranged in a bridge-like manner, cutters 6. The drilling head 5 is provided with two, located inwardly with respect to the cutters 6, drillings removal grooves 7*a*, 7*b* which are associated with respective cutters 6. The earth borer 1 further includes an easily releasable tubular connection member 8 that connects the shank 2 with the tubular shaft for joint rotation with each other.

The tubular connection member 8 has a radially offset connection rim 9 coaxial with the tubular shaft 4, with the rim 9 and the tubular shaft 4 fitting into each other. The tubular connection member 8 further includes a plurality of radially projecting driving elements 11 which engage in respective tangent-bent, in the rotational direction of the borer, slots 10 formed in the wall of the tubular shaft 4 and open at their end sides. The driving elements 11 and the slots 10 form a bayonet connection that provides for driving connection of the tubular shaft 4 with the shank 2.

The drilling head 5 has a rim 12 with which is circumferentially welded to the tubular shaft 4. The mirror-symmetrical cutters 6, which have a flat bottom surface in the radial direction and which taper forward a tip point located on the borer axis A, diametrically span the drilling head rim 12.

Figure 2:
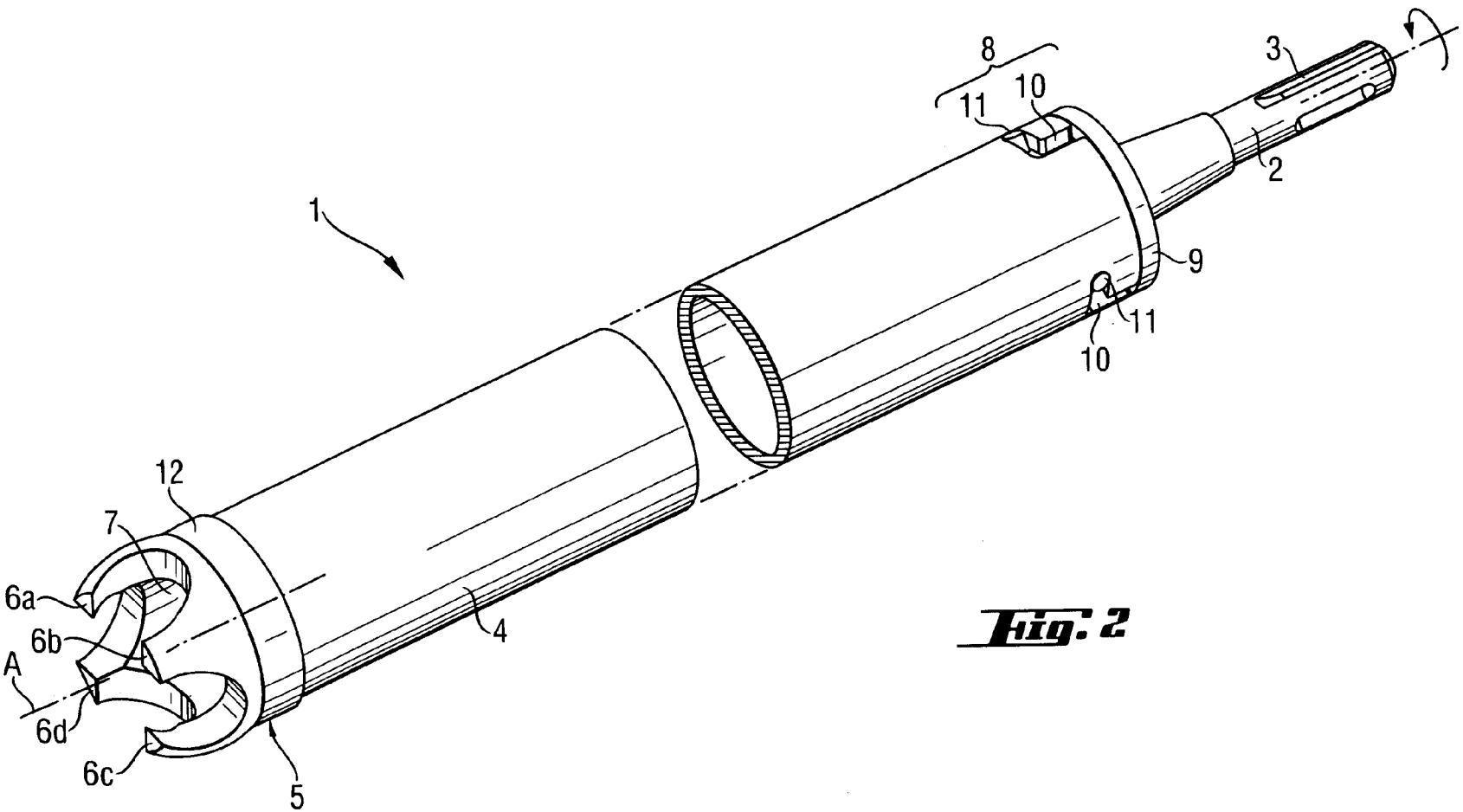
FIG. 2 a perspective, partially cross-sectional view of a second embodiment of earth borer according to the present invention.

In the earth borer shown in FIG. 2 there are provided four cutter 6*a*, 6*b*, 6*c*, and 6*d*, which are arranged rotationally symmetrically and taper inward from the drilling head rim 12 toward the tool axis A, without touching the same, whereby a central drillings-removing groove 7 is formed. The cutters 6*a*, 6*b*, 6*c*, 6*d* have a sector-like shape and have all a flat bottom surface in the radial direction.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or detail thereof, and the present invention includes all variations and/or alternative embodiments within the spirit and scope of the present invention as defined by the appended claims.

What is claimed is:

1. An earth borer, comprising a thin-walled tubular shaft (4) having smooth inner and outer surfaces; a shank (2) provided at one end of the tubular shaft (4); a drilling head (5) provided at another, opposite end of the tubular shaft, projecting radially beyond the tubular shaft (4), and having at least one cutter (6, 6*a, 6b, 6c, 6d*) extending, at least partially, radially inward and at least one internal groove (7, 7*a, 7b*) associated with the at least one cutter (6*a, 6b, 6c, 6d*), and a releasable tubular connection member (8) for drivingly connecting the shank (2) with the tubular shaft (4) for joint rotation with each other, wherein the drilling head (5) has a rim (12) for fixedly circumferentially connecting the drilling head (5) with the tubular shaft (4), and wherein the cutter (6) tapers towards a tip point lying on a borer axis (A) and diametrically spans the head rim (12).

2. An earth borer according to claim 1, wherein the cutter (6) is arranged mirror-symmetrically with respect to the borer axis (A).

3. An earth borer, comprising a thin-walled tubular shaft (4) having smooth inner and outer surfaces; a shank (2) provided at one end of the tubular shaft (4); a drilling head (5) provided at another, opposite end of the tubular shaft, projecting radially beyond the tubular shaft (4), and having at least one cutter (6, 6*a, 6b, 6c, 6d*) extending, at least partially, radially inward and at least one internal groove (7, 7*a, 7b*) associated with the at least one cutter (6*a, 6b, 6c, 6d*), and a releasable tubular connection member (8) for drivingly connecting the shank (2) with the tubular shaft (4) for joint rotation with each other, wherein the drilling head (5) has a rim (12) for fixedly circumferentially connecting the drilling head (5) with the tubular shaft (4), and wherein the drilling head (5) has a plurality of cutters (6*a, 6b, 6c, 6d*), which are sector-shaped, taper from the head rim (12) toward the borer axis (A) without touching the borer axis (A), and have a flat bottom surface in a radial direction.

4. An earth borer according to claim 3, wherein the plurality of cutters (6*a, 6b, 6c, 6d*) are arranged rotationally symmetrically with respect to the borer axis (A).

* * * * *